US005090595A

United States Patent [19]

Vandoninck

[11] Patent Number: 5,090,595

[45] Date of Patent: * Feb. 25, 1992

[54] PRESSURE CAPSULE FOR SPRAY CAN, AND SPRAY CAN WHICH UTILIZES SUCH A CAPSULE

[75] Inventor: Alfons Vandoninck, Antwerpen, Belgium

[73] Assignee: Jaico C.V., Cooperatieve venootschap, Antwerpen, Belgium

[ * ] Notice: The portion of the term of this patent subsequent to Feb. 26, 2008 has been disclaimed.

[21] Appl. No.: 659,574

[22] Filed: Feb. 22, 1991

Related U.S. Application Data

[62] Division of Ser. No. 371,842, Jun. 27, 1989, Pat. No. 4,995,533.

[30] Foreign Application Priority Data

Jun. 29, 1988 [BE] Belgium ..... 8800747
Oct. 3, 1988 [BE] Belgium ..... 8801131

[51] Int. Cl.[5] ..... B67D 5/08

[52] U.S. Cl. ..... 222/54; 222/399; 222/402.1; 53/470

[58] Field of Search ..... 222/54, 61, 130, 396, 222/399, 394, 402.1, 510, 3, 1, 129, 145; 53/470

[56] References Cited

U.S. PATENT DOCUMENTS

| | | | |
|---|---|---|---|
| 2,794,579 | 6/1957 | McKernan | 222/399 |
| 3,243,085 | 3/1966 | Wilson | 222/396 |
| 3,815,793 | 6/1974 | Morane et al. | 222/399 |
| 3,995,778 | 12/1976 | Gamadia | 222/399 |
| 4,995,533 | 2/1991 | Vandoninck | 222/61 X |

*Primary Examiner*—Kevin P. Shaver
*Attorney, Agent, or Firm*—Foley & Lardner

[57] ABSTRACT

Pressure capsule for spray can, characterized by the fact that it principally consists of at least two chambers (2, 3), the first of which (2) is intended to be filled with fluid under relatively high pressure and the second of which (3) is intended to be filled with a fluid up to a pressure equal or practically equal to the overpressure which normally exists in a spray can (19) and which is needed for expelling a liquid (18); in the wall of the second chamber (3), a membrane (5) that can control the valve (4); and a removable element (6) that, in its unremoved condition, keeps the valve (4) closed.

32 Claims, 5 Drawing Sheets

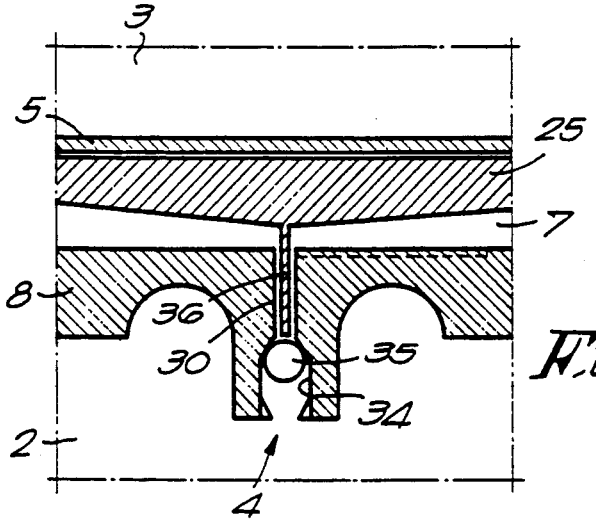
Fig. 11
Fig. 12
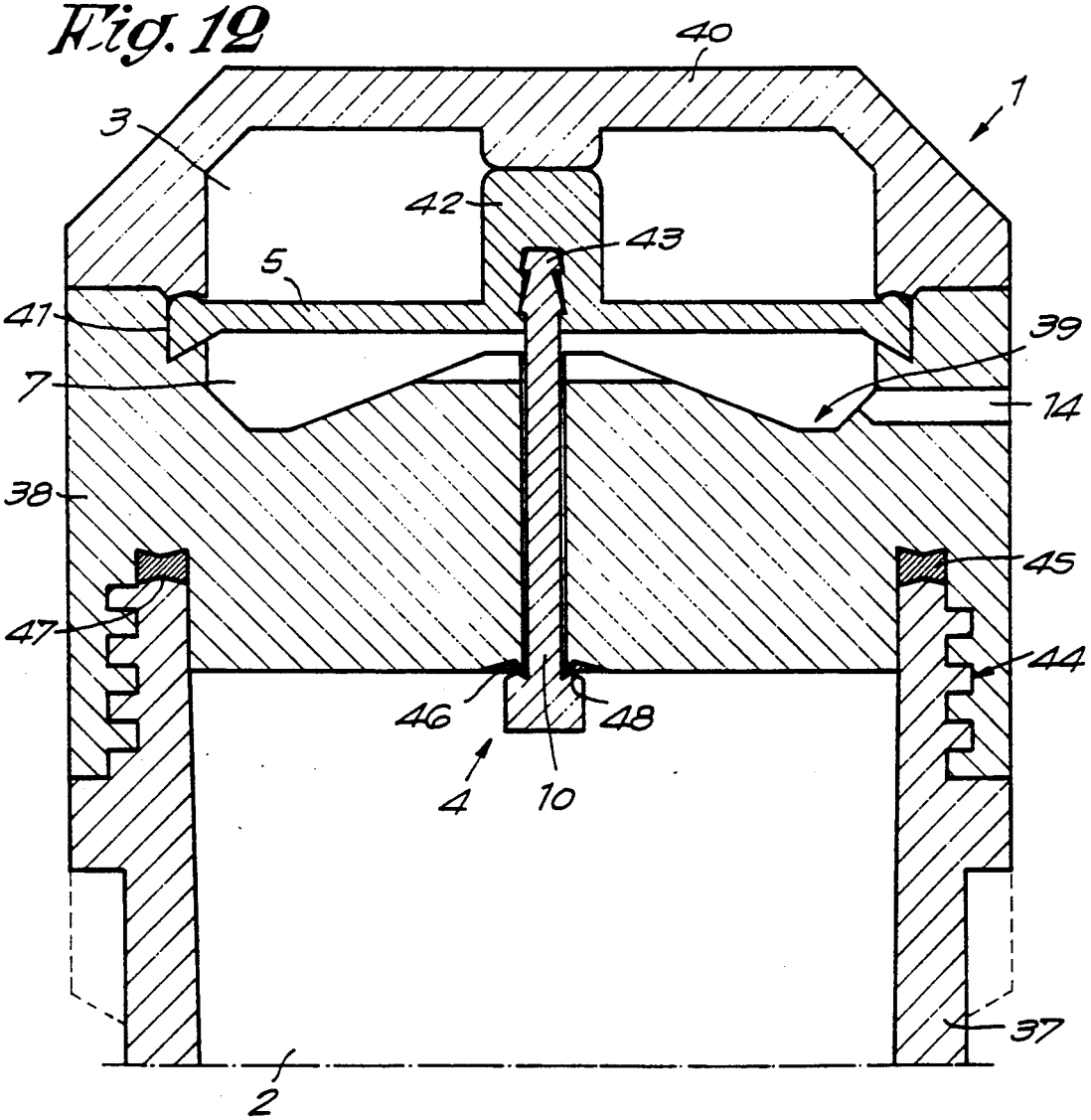

PRESSURE CAPSULE FOR SPRAY CAN, AND SPRAY CAN WHICH UTILIZES SUCH A CAPSULE

This application is a division of application Ser. No. 07/371,842, filed June 27, 1989 issued as U.S. Pat. No. 4,995,533 on Feb. 26, 1991.

BACKGROUND OF THE INVENTION

1. Field of the Invention

The present invention concerns a pressure capsule, as well as a spray can which utilizes such a capsule.

2. Discussion of the Related Art

It is known that, up to the present time, the pressure in spray cans is often obtain by equipping the can with propellants which produce negative effects on the environment. Such a propellant is, for example, composed of chlorofluoro hydrocarbons, butane, propane or other such substances.

Indeed, such propellants have negative effects not only on the health but, as is generally known, also on the protective ozone layer surrounding the earth, with all its known and unknown consequences.

Hence there is a general movement to exclude the use of such propellants and to offer sprayers and such similar apparatuses in which the pressure needed for expelling a liquid out of a receptacle is built up on the basis of compressed air produced by manually operating a pump that is part of the spray can or similar apparatus. It is obvious, however, that such manual operation of a sprayer or similar apparatus is not attractive in use and that it practically precludes a uniform vaporization.

SUMMARY OF THE INVENTION

The present invention concerns a pressure capsule which, during or before the filling of a spray can or similar apparatus, is installed in the latter and offers the possibility of eventually making use of either compressed air or an inert gas as a propellant for such a spray can, in such way that a spray can is obtained which does not have any negative influence on the environment and which, moreover, possesses the simplicity and flexibility of operation which at this time is only to be found with spray cans containing the above mentioned harmful propellants.

For this purpose, according to the invention, the pressure capsule consists principally of at least two chambers, the first of which is intended to be filled with a fluid under relatively high pressure and the second of which is intended to be filled with fluid up to a pressure equal or practically equal to the overpressure which is normally present in a spray can and which is needed for expelling a liquid; in the wall of the first chamber is a valve; in the wall of the second chamber is a membrane which can control the valve; and a removable element which, in its unremoved condition, keeps the valve closed. The removable element can thus, directly or indirectly, have an effect on the valve in order to keep it closed, and consists preferably of a material which melts at a low temperature or which dissolves under influence of the liquid in the spray can. In a variant form, a mechanically removable element can also be utilized.

After the above mentioned element is removed, the above mentioned valve is regulated by the membrane such that fluid is released from the first chamber as long as the pressure in the environment of the pressure capsule is becoming lower, or in any case is noticeably lower, than the pressure in the second chamber of the pressure capsule.

According to the invention, in the most preferred model the pressure capsule consists principally of three chambers of which, as mentioned above, the first is intended to be filled with a fluid under relatively high pressure; the second and third are intended to be filled with one and the same fluid, up to or practically up to the overpressure which normally is present in a spray can or similar apparatus for expelling a liquid; between the first and the third chamber is a connecting valve; between the second chamber and the third chamber is a membrane which can control the valve, and means for sealing the third chamber off from the environment, these means being in the above mentioned removable element. The presence of the removable element provides, in this case, for the indirect closing of the valve, which occurs because a counterpressure on the membrane can build up in the closed third chamber until a balance is achieved, whereupon the valve closes.

The present invention also concerns a spray can which utilizes an above mentioned pressure capsule, in which the latter either is installed as a loose element after the filling of the spray can, or else it constitutes a fixed part of this spray can.

BRIEF DESCRIPTION OF THE DRAWINGS

In order to better demonstrate the characteristics of the invention, as examples without any limiting character, some preferred forms of a pressure capsule according to the invention are described below, with reference to the appended drawings, in which:

FIG. 2 depicts a spray can in which a pressure capsule according to. FIG. 1 is utilized;

FIG. 5 depicts in larger scale the part indicated by F6 in FIG. 5;

FIG. 11 depicts another variant of the part indicated by F6 in FIG. 5;

FIG. 12 depicts an especially practical version of the pressure capsule;

DETAILED DESCRIPTION OF THE PREFERRED EMBODIMENTS

Figure 1:
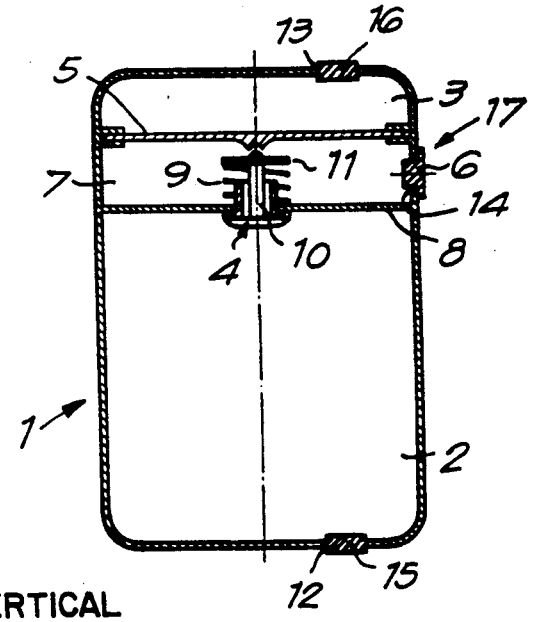
FIG. 1 depicts a pressure capsule according to the invention, schematically and in cross-section.

FIG. 1 depicts a pressure capsule (1) according to the invention, which can be assembled in any suitable way by means of screws, welding or similar methods; in this drawing, however, for simplicity it is pictured as if it consisted, practically speaking, of one whole. According to the present invention such a pressure capsule consists of at least two chambers, the first of which (2) is intended to be filled with a fluid under relatively high pressure and the second of which (3) is intended to be filled with a fluid with a pressure which is equal or practically equal to the overpressure which is normally utilized in spray cans; in the wall of the first chamber (2) is a valve (4); in the wall of the second chamber (3) is a membrane (5) which can control the valve (4), and a removable element (6) which in its non-removed condition can keep the valve (4) directly or indirectly closed.

In the most preferred version, use is made of a third chamber (7), situated between the above mentioned chambers (2) and (3), in such a way that the valve (4) is located in the wall (8) between the first chamber (2) and the third chamber (7), while the membrane (5) is installed in the wall between the second chamber (3) and the third chamber (7). The valve (4) can be fitted with a spring (9), which is installed between the wall (8) and a pushing plate (11) fixed on the valve stem (10). The spring (9) here exerts a very light force in order to keep the valve (4) closed. The membrane (5) is freely situated above the valve stem (10) and, through distortion due to the existence of a larger pressure in the one chamber (3) than in the other chamber (7), it is able to come out of its neutral position and open the valve (4).

In the version according to FIG. 1, the three chambers (2-3-7) display external openings (12, 13 and 14) to the environment of the pressure capsule (1); each of these openings is sealed by the components 15, 16 and 17 respectively.

According to the invention, the first chamber (2), for example, is filled via the opening (12) with a fluid under high pressure, such as compressed air or another gas, preferably, though not necessarily, an inert gas. The pressure can be as high as 100 kg/cm2, though preferably of the order of 4 to 35 kg/cm2. After this, the opening (12) is sealed with the component (15).

According to a variant, the first chamber (2) can be filled with a fluid which under atmospheric pressure forms a gas which, under higher pressure (between 4 kg/cm2 and 100 kg/cm2) and at a temperature higher than zero degrees Celsius, becomes a liquid, as for example freon 502, freon 22, propane, etc., since these liquids, if used as ordinary spray can propellant, create too high a vapor pressure. If the reservoir (2) is filled with one or a combination of these liquids, the pressure regulation system of the pressure capsule (1) will ensure that the propellants which are released have a suitable normalized propellant pressure and are released only at the desired moment, i.e. when the element (6) is removed. Through the utilization of this principle, it becomes possible to sharply reduce the volume of the reservoir (2) and to utilize new gases, which until now could not be used as propellants.

At the same time, the second chamber (3) is filled with compressed air or another fluid via the opening (13), up to an overpressure which is equal to the pressure needed in a spray can as a propellant medium for expelling fluids from such a spray can, (for example, of the order of 0.5 to 4.5 kg/cm2), after which the sealing of the opening (13) is ensured by the component (16).

Components 15 and 16 are permanent, while the above mentioned component (17) is formed by the removable element (6).

According to a first variant version, the removable element (6) will be produced in a material which melts at a well-determined low temperature, for example a material that melts at a temperature of 30 to 50 degrees Celsius, such as, for example, wax, hot melt or similar substances.

It is clear that the removable element (6) indirectly ensures that the valve (4) remains closed, at least as long as this element (6) is present. Through the presence of the element (6), the pressure in the third chamber (7) remains or can build up from the first chamber (2), whereby the pressure which is either present or has built up in the third chamber (7) keeps the valve (4) closed until the pressure capsule (1) is employed, in other words until the element (6) is removed.

Figure 2:
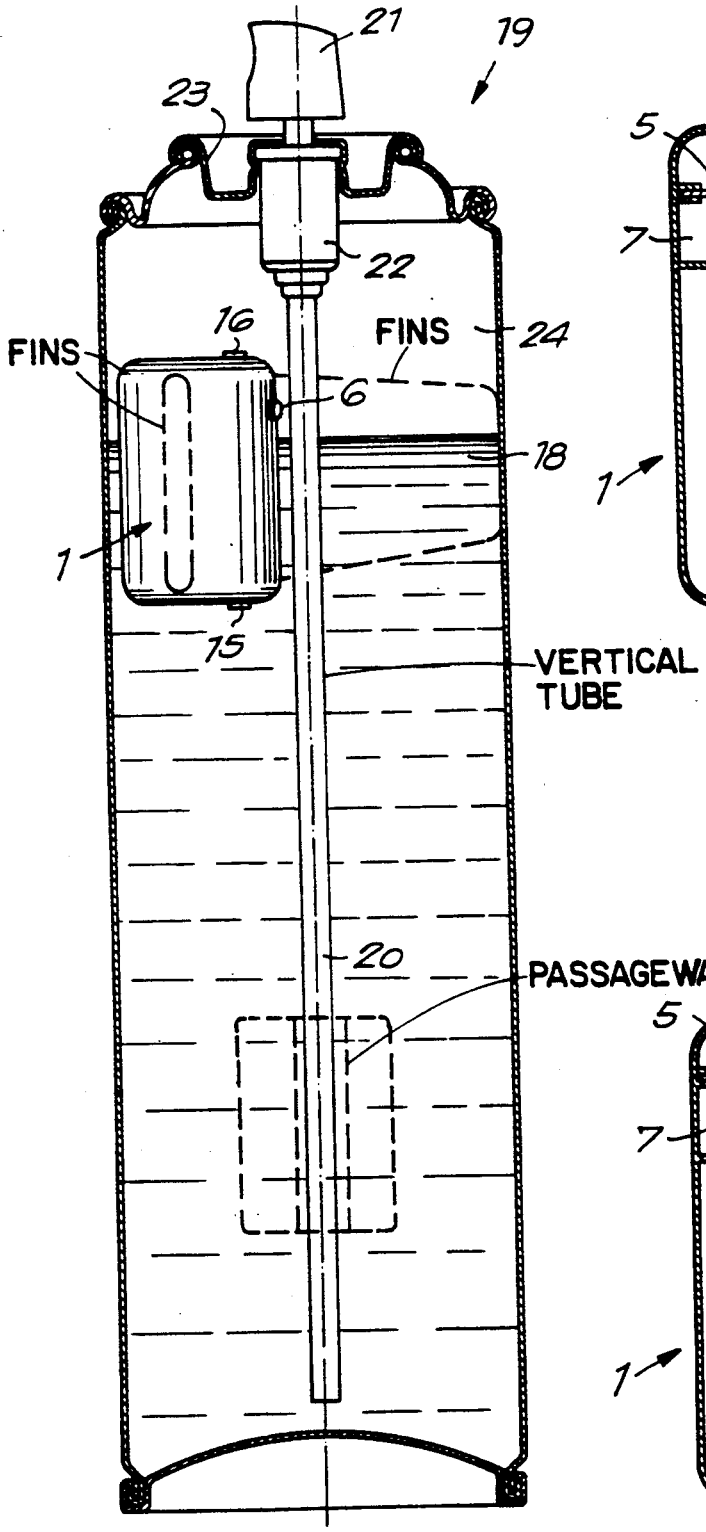

A pressure capsule (1), as described above, can be utilized to great advantage in a spray can (19) filled with liquid (18), as depicted in FIG. 2, in order to provide the pressure medium, in this case air, that serves to drive the liquid (18) out of the spray can; this occurs via a vertical tube (20) and is controlled by a valve (22) operated by means of a push button (21). For this purpose the pressure capsule (1) is installed in the actual spray can (19) before, during or after the filling of the spray can (19), and before the installation of the sealing lid (23), with the vertical tube (20) and valve (22) attached to it.

Figure 3:
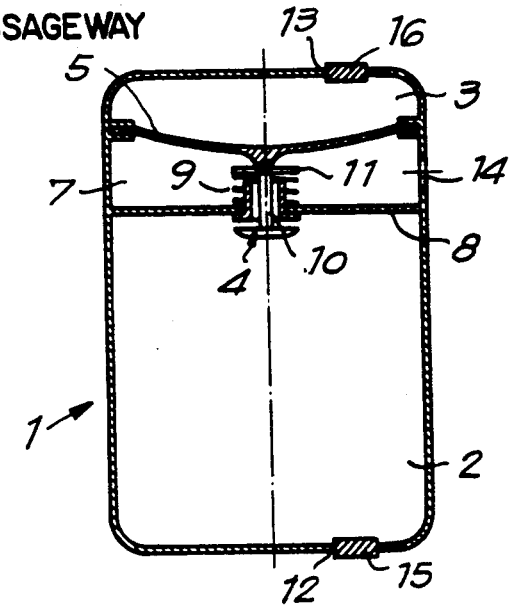
FIG. 3 is a view similar to that of FIG. 1, but for a second characteristic position.

After the spray can (19) is filled and sealed, it is sufficient to warm up the whole to the melting temperature of the element (6). This causes the element (6) to melt away or to be pushed out of the capsule (1) by the overpressure in the third chamber (7). This then also causes the fluid to escape out of the third chamber (7) into the space (24) above the liquid (18), so that the pressure in the third chamber (7) falls. As long as the pressures in the second chamber (3) and the third chamber (7) noticeably differ, the membrane flexes, comes in contact with the valve stem (10) and opens the valve (4), as depicted in FIG. 3. Fluid from the first chamber (2), which is under high pressure, is thus emitted into the third chamber (7), and hence also into the space (24). Only when the pressure in the third chamber (7), and thus also in the space (24), is equal or practically equal to the pressure in the second chamber (3) is the valve (4) closed by the fact that the membrane (5) again assumes a neutral position. We note here that the spring (9) is by preference very weak and thus does not influence the equilibrium of forces.

It is obvious that whenever liquid (18) is vaporized, the volume of the space (24) increases and the pressure within it falls, so that, as previously mentioned, pressure will again be delivered from the pressure capsule. In view of the fact that the pressure in the first chamber (2) and the volume of this chamber obviously are calculated in terms of the amount of liquid (18) to be vaporized, the above described operating cycle will always repeat itself until all the liquid is expelled.

It is obvious that in this way we obtain a pressure capsule—and thus a spray can which utilizes such a pressure capsule—by means of which an environmentally harmless propellent fluid, such as regular air or an inert gas, can be utilized: in other words, a fluid which is neutral for the environment, as well as for the liquid to be vaporized. At the same time, we obtain a safe and dependable spray can pressure, which is not influenced by temperature.

In certain cases the pressure capsule (1) can be provided with fins or similar fixtures, (not shown in the drawings), which can serve to fix such a capsule to a certain extent between the wall of the spray can (19) and the vertical tube (20).

Figure 4:
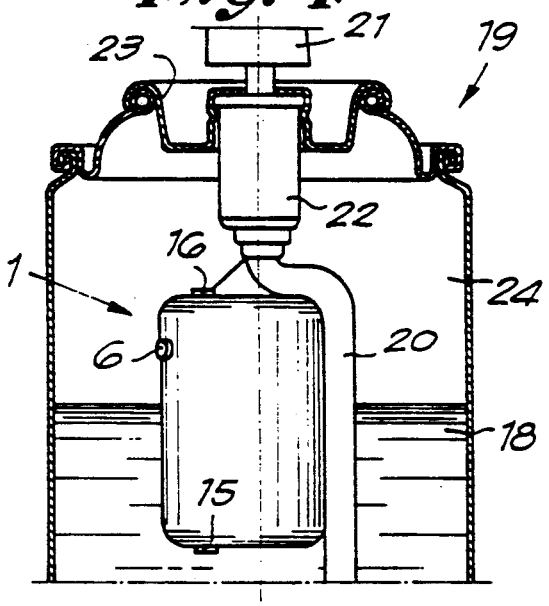
FIG. 4 depicts a variant of FIG. 2.

In another version, such as depicted schematically in FIG. 4, the pressure capsule (1) can, for example, also be attached under the valve (22) of the spray can (19).

Of course other possibilities can be contemplated for attaching the pressure capsule (1) in a spray can; for example a pressure capsule with a central passageway through which the vertical tube (20) passes can be utilized.

The element (6) does not necessarily need to be made of material which melts at a raised temperature. In order to make this element (6) removable, a material can also be used which, after external treatment, (for example by radiation, magnetization or similar processes), or after an internal reaction, (for example by delayed self-destruction or by dissolving in the liquid (18) of the spray can (19)), either loses its sealing properties or else totally falls apart. Polyvinyl alcohol and similar substances are soluable materials that come into consideration for many applications.

The element (6) can also consist of a material which can be pierced, pushed in or pushed away by means which, for example, are made available in the push button (21) of the valve (22) and which, upon their first use, affect the element (6).

Figure 5:
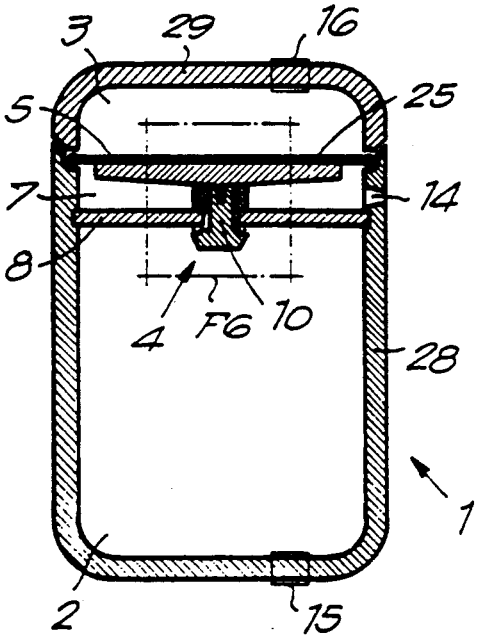
FIG. 5 depicts a variant of the invention.
Figure 6:
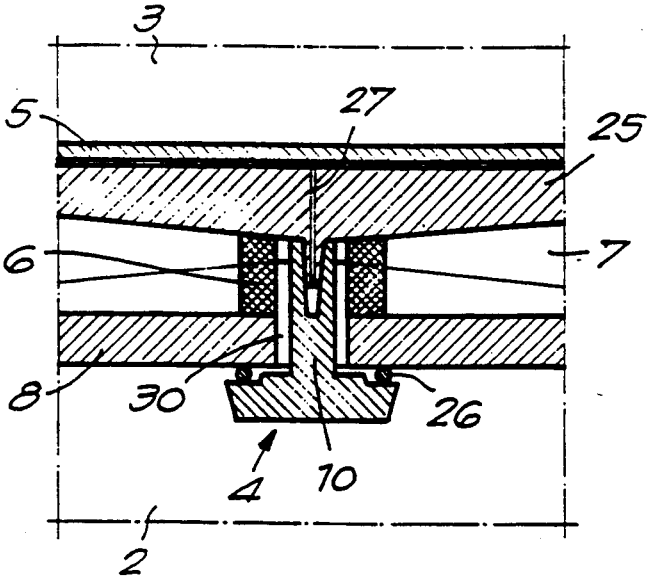

In FIGS. 5 and 6, a variant of the invention is depicted in which a removable element (6) is utilized that forms a mechanical lock for the valve (4). The element (6) is composed of one of the above mentioned materials, preferably a material which melts at a low temperature, such as wax, or a material which dissolves in the liquid (18), such as sugar.

In the version according to FIG. 5, the valve (4) with the valve stem (10) is attached to a membrane plate (25) which may or may not be attached to the membrane (5). The element (6) has the form of a ring and is located between the membrane plate (25) and the above mentioned wall (8). As is depicted in detail in FIG. 6, the correct seal of the valve (4) is obtained by means of an O-ring (26). The valve (4) can be glued to the valve plate (25) by means of the valve stem (10); the canal (27) provides ventilation for the drying of the glue.

Figure 7:
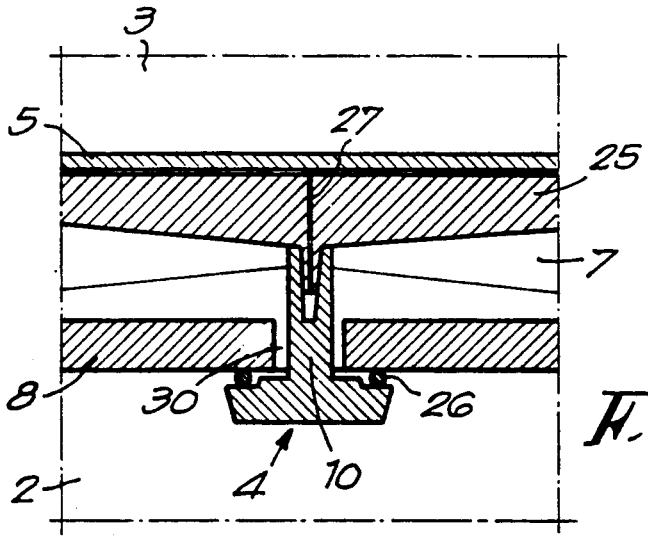
FIG. 7 depicts the part indicated by F6 of FIG. 5 in another condition.

FIG. 7 represents a condition in which element 6 is removed by melting, dissolving or some such process. From that moment on, the operation of the pressure capsule in FIG. 5 is identical to that in FIG. 1.

The three-chamber pressure capsule offers the advantage that it can be produced completely in synthetic material in a simple construction, so that the cost price of the capsule can be kept low. According to one of the possible variants, as depicted in FIG. 5, a reservoir (28) can be utilized in which the middle wall (8) with the valve (4) and the membrane plate (25) are mounted, after which the reservoir (28) is closed by means of a lid (29) which is, for example, welded or glued to it, while the above mentioned membrane (5) is enclosed between the edges of the reservoir (28) and the lid (29). Naturally, the reservoir (28) is provided with the above mentioned opening (14). It is obvious that in the form of the version in FIG. 5 an element (6) could also be used to ensure the sealing of the opening (14), analogous to the situation depicted in FIG. 1.

Figure 8:
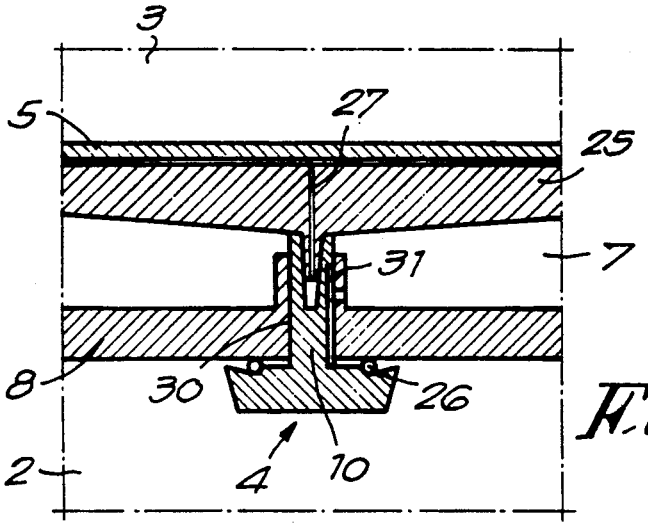
FIGS. 8 and 9 depict variants of the part indicated by F6 of FIG. 5.

In the versions in FIGS. 5 and 7 the flow of the fluid from the first chamber (2) to the third chamber (7) occurs via the valve (4), because the valve stem (10) has a noticeably smaller diameter than the opening (30) in the wall (8). In FIG. 8 on the one hand, and FIGS. 9 and 10 on the other, two variants are depicted in which the valve stem (10) has the same diameter as the opening (30) and in which notches, (31) and (32), are made in the valve stem (10) and in the wall of the opening (30), respectively, in order to let the fluid through.

Figure 9:
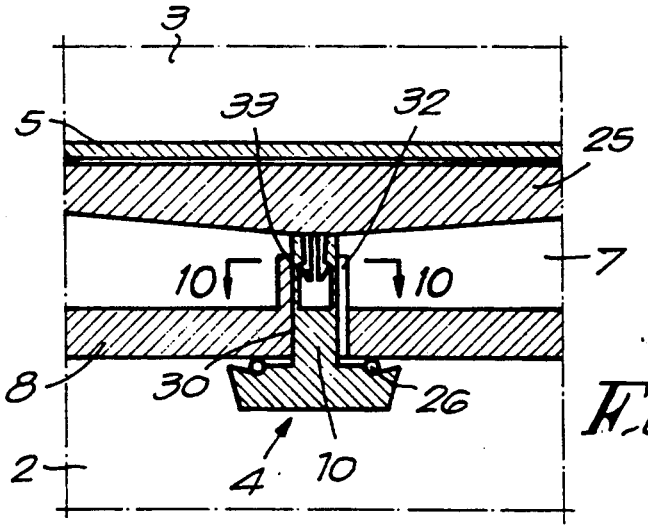
Figure 10:
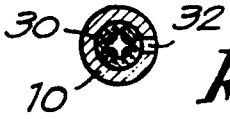
FIG. 10 depicts a cross section along line x—x in FIG. 9.

In the versions in FIGS. 9 and 10, the valve (4) and the valve stem (10) are connected to the membrane plate (25) by means of barbed elements (33).

FIG. 11 depicts another variant in which the valve (4) is formed by a ball bearing (35) fitted into a seat (34) in the wall (8). The ball bearing (35) is controlled by means of a valve pusher (36) attached to the membrane plate (25).

In the most preferred version, use is made of a construction such as depicted in FIG. 12. For this purpose the pressure capsule (1) is assembled from a reservoir (37), a closure housing (38) which seals the reservoir (37) and which, on its top side, has a hollow (39), and a lid (40) which is placed on top of it. The closure housing (38) and the lid (40) are made such that, upon being put together, they form a seat (41) for the enclosure of the membrane (5). Naturally, the closure housing (38) also has the above mentioned side opening (14), as well as a passage for the valve stem (10), along which also the fluid from the first chamber (2) can come into the third chamber (7), which is formed by the hollow (39). The respective parts are made out of synthetic materials which are reinforced either with fiber glass or with another filler-reinforced synthetic material.

The membrane (5) has a centrally located thickening (42) in which the valve stem (10) is clamped by its tip (43), preferably by means of a barb.

The attachment of the closure housing (38) on the reservoir (37) is done by means of square-angled screw thread (44) in order to prevent the occurence of sliding forces through which the whole, under the influence of the high pressure in the first chamber (2), could be distorted and tear apart. Upon assembly, silicon or similar substances are applied to the screw thread (44) and excercise a lubricating effect when the closure housing (38) is screwed down, whereas afterwards, through the hardening of the silicon or similar substances, a perfect seal is obtained. Furthermore, in the closure housing (38) there are seals (45 and 46) which work together, on the one hand with the edge (47) of the reservoir (37), and on the other hand with a sharp edge (48) on the valve (4).

The lid (40) is attached to the closure housing (38) by means of silicon, glue, welding, or by melting together.

Before the lid (40) is mounted, the first chamber (2) can be filled along this valve by pressing in the valve (4), or else it can be filled along an opening (12), not depicted in FIG. 12, which then, as depicted in FIG. 1, is closed by sealing components (15).

The pressure in the second chamber (3) can, for example, be created by bringing the lid (40) into an environment where the desired pressure is present. On the other hand, it is also possible to provide a filling hole (13), analogous to that in FIG. 1. As depicted in the versions discussed above, the chambers are still preferably set up axially behind one another, and the membrane (5) and the valve (4) are located centrally with respect to the axis of the capsule.

Figure 13:
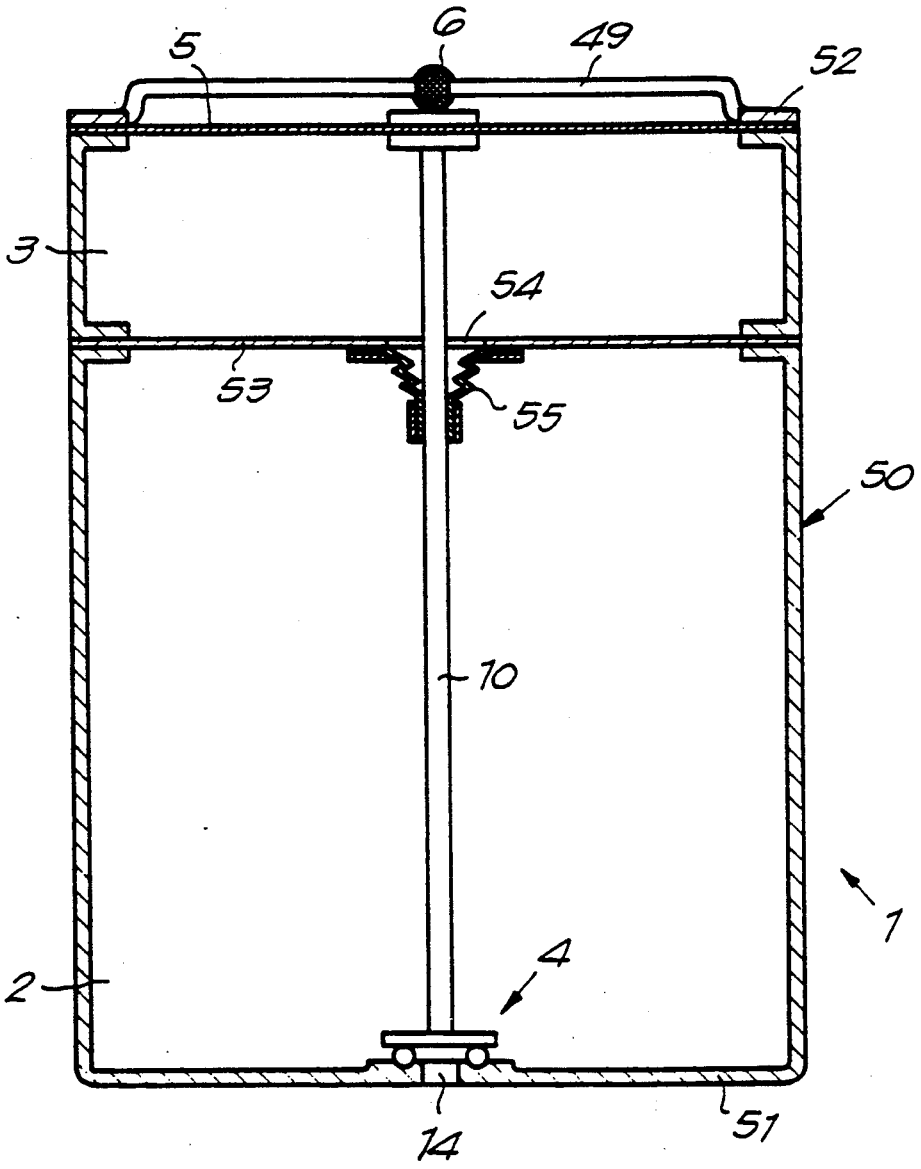
FIG. 13 depicts a special version of the pressure capsule.

In FIG. 13 a version is schematically depicted which utilizes only the two chambers (2 and 3). The valve (4) of the first chamber (2), as well as the membrane (5) of the second chamber (3), are in direct contact with the environment of the pressure capsule (1). The valve (4) is connected to the membrane (5) by means of the valve stem (10). Before the use of the pressure capsule, the membrane (5) is kept in such a condition that the valve (4) is closed. In this way the movement of the membrane (5) is prevented by a removable element (6) that forms a mechanical lock. According to FIG. 13, the element (6) consists of a meltable mass placed in a holder (49); this mass works together directly with the tip of the valve stem. Here the element (6) consists of one of the above mentioned materials and, after the pressure capsule (1) is installed in a spray can, can be pushed loose, melted, dissolved, etc.

In the event that only two chambers are made use of, the pressure capsule preferably displays a configuration such as is depicted in FIG. 13, in other words, a pressure capsule (1) which is formed out of a cylinder (50), a first end wall (51) in which the valve (4) is mounted, a second end wall (52) in which the membrane (5) is installed, and a partition (53) which forms the separation between the first chamber (2) and the second chamber (3) and which has a passageway (54) for the valve stem (10). The opening around the valve stem (10) is closed by means of a sealing joint (55).

The present invention is in no way limited to the versions described above and depicted in the FIGS., but such a pressure capsule and a spray can which utilizes such pressure capsule can be produced in different forms and dimensions, without going outside the framework of the invention.

I claim:

1. In a spray can (19) having a liquid (18) to be expelled, a pressure capsule fixedly mounted in the spray can, the capsule comprising first and second chambers (2, 3), the first chamber being filled with a first fluid under a first pressure and the second chamber being filled with a second fluid under pressure approximately equal to an overpressure present in the spray can for expelling the liquid (18), the first pressure being higher than the overpressure; a valve (4) in a wall of the first chamber (2); a membrane (5) forming a wall of the second chamber and controlling the valve (4); a removable element (6) for maintaining the valve (4) in a closed position when the removable element is in its non-removed condition, wherein the capsule can be prepressurized when the removable element is in its non-removed condition.

2. Pressure capsule according to claim 1, wherein the removable element (6) forms a mechanical lock for the valve (4).

3. Pressure capsule according to claim 1, including a third (7) chamber, the second and third chambers being filled with one and the same fluid, which is under a pressure approximately equal to the overpressure for expelling a liquid (18); the valve (4) is positioned between the first chamber (2) and the third chamber (7); the membrane (5) is located between the second chamber (3) and the third chamber (7) for controlling the valve (4).

4. Pressure capsule according to claim 1, wherein the chambers (2, 3, 7) are filled with pressurized air.

5. Pressure capsule according to claim 1, wherein the chambers (2, 3, 7) are filled with an inert gas.

6. Pressure capsule according to claim 1, wherein the first chamber (2) is filled with a fluid that occurs in liquid form under the pressure which is applied in the first chamber (2).

7. Pressure capsule according to claim 1, wherein the valve (4) is also forced into its closed position by a spring (9).

8. Pressure capsule according to claim 1, wherein the valve has a valve stem having a free tip, the free tip of the valve stem (10) is located in the vicinity of the membrane (5) when the valve (4) is closed.

9. Pressure capsule according to claim 1, wherein at least the first chamber (2) and the second chamber (3) have openings (12, 13) and means for sealing the openings.

10. Pressure capsule according to claim 1, wherein the chambers (2, 3, 7) are arranged on an axis, one behind the other.

11. Pressure capsule according to claim 1, wherein the valve (4) is centrally positioned with respect to the axis of the capsule.

12. Pressure capsule according the claim 1, wherein the capsule has an axial passageway, the diameter of which is larger than that of a vertical tube (20) of the spray can (19).

13. Pressure capsule according to claim 1, wherein the walls of the pressure capsule (1) are fitted with at least one fin for fixedly mounting said capsule.

14. Pressure capsule according to claim 1, wherein the pressure in the first chamber (2) is on the order of 4 to 35 $kg/cm^2$.

15. Pressure capsule according to claim 1, wherein the overpressure in the second chamber (3) is on the order of 0.5 to 4.5 $kg/cm^2$.

16. Pressure capsule according to claim 1, wherein the pressure capsule is principally made of synthetic material.

17. Pressure capsule according to claim 6, wherein the synthetic material is reinforced with a filler of fiber glass.

18. Pressure capsule according to claim 1, wherein the pressure capsule comprises a reservoir (28); a partition (8) attached to the reservoir; a closure housing (29) that closes off the reservoir; and a membrane (5) mounted between edges of the reservoir (28) and the closure housing (29), the valve (4) being mounted in the partition (8).

19. Pressure capsule according to claim 1, wherein the pressure capsule comprises a valve stem forming part of the valve; a closure housing separating the first and second chambers, the closure housing having a top, bottom and side and wherein the top has a hollow, and the side has an opening, and further comprising a passageway for the valve stem and for the fluid out of the first chamber; the second chamber comprising a lid attached to the closure housing; a membrane mounted between the closure housing and lid; and wherein the valve stem is attached to the membrane.

20. Pressure capsule according to claim 19, wherein the closure housing (38) is attached to the reservoir (37) by means of square-angled screw thread (44).

21. Pressure capsule according to claim 20, wherein silicon is applied between the screw threads (44).

22. Pressure capsule according to claim 1, wherein along the membrane (5) a membrane plate (25) is provided, to which a valve stem (10) of the valve (4) is attached.

23. Pressure capsule according to claim 1, wherein the valve (4) comprises a ball bearing (35) fitted in a set (34); the ball bearing (35) can be moved by means of a valve pusher, which works together with the membrane (5).

24. Pressure capsule according to claim 1, wherein the pressure capsule is comprised solely of the two chambers (2, 3); the membrane (5) and the valve (4) open onto the environment of the pressure capsule (1).

25. Pressure capsule according to claim 24, wherein the pressure capsule principally comprises a cylinder (50); placed in the cylinder, is a partition (53), which divides the cylinder (5), respectively, into the first and second chambers (2, 3); a first end wall (51), in which the valve (4) is mounted; a second end wall (52), in which the membrane (5) is placed; passing through the partition (53) is a valve stem (10), which connects the membrane (5) internally with the valve (4) and, clamped in a holder (49), is the removable element (6) which, by its presence, prevents the membrane (5) from flexing outward.

26. Pressure capsule fixedly mounted in a spray can, comprising: first and second chambers (2, 3), the first chamber of which (2) is intended to be filled with a fluid under a first pressure and the second chamber (3) which is intended to be filled with a fluid that is under a pressure which is up to a pressure equal or practically equal to the overpressure that is present in a spray can (19) and which is needed for expelling a liquid (18), the first pressure being higher than the overpressure; in the wall of the first chamber (2) a valve (4); in the wall of the second chamber (3) a membrane (5) that can control the valve (4); and a removable element (6) which, in its non-removed condition, keeps the valve (4) closed, the removable element (6) being made of a material having a melting temperature of 30 to 50 degrees Celsius.

27. Pressure capsule according to claim 26, wherein the material utilized is wax.

28. Pressure capsule fixedly mounted in a spray can, comprising: at least two chambers (2, 3), the first chamber of which (2) is intended to be filled with a fluid under a first pressure and the second chamber (3) which is intended to be filled with a fluid that is under a pressure which is up to a pressure equal or practically equal to the overpressure that is present in a spray can (19) and which is needed for expelling a liquid (18), the first pressure being higher than the overpressure; in the wall of the first chamber (2) is a valve (4); in the wall of the second chamber (3) is a membrane (5) that can control the valve (4); and a removable element (6) which, in its non-removed condition, keeps the vale (4) closed, the removable element (6) being produced of a material that is soluble in the liquid (19) of the spray can (19) for which the capsule (1) is intended.

29. Pressure capsule according to claim 28 wherein the removable element (6) is sugar.

30. Pressure capsule according to claim 28, wherein the removable element (6) is polyvinyl alcohol.

31. Method of making a capsule for insertion into a spray can, comprising:

a) forming a pressure capsule with first and second pressure chambers, b) filling the first chamber with a first fluid under a first pressure higher than an overpressure present in the spray can when filled with liquid for expelling a liquid, c) filling the second chamber with a second fluid under a pressure approximately equal to the overpressure, (d) forming a valve in a wall of the first chamber, (e) forming a wall of the second chamber of a membrane, the membrane cooperating with the valve, (f) placing a removable element on the capsule, g) after filling the chambers with fluid, placing the capsule in the spray can wherein the capsule is fixedly connected in the spray can.

32. The method of claim 31, including filling the spray can with liquid.

* * * * *